United States Patent [19]

Nelson

[11] Patent Number: 4,489,531

[45] Date of Patent: Dec. 25, 1984

[54] ENVIRONMENTALLY ADAPTABLE ROOF STRUCTURE

[75] Inventor: Nyal E. Nelson, Herndon, Va.

[73] Assignee: The United States of America as represented by the Secretary of the Army, Washington, D.C.

[21] Appl. No.: 451,992

[22] Filed: Feb. 23, 1983

Related U.S. Application Data

[60] Division of Ser. No. 164,490, Jun. 30, 1980, , which is a continuation-in-part of Ser. No. 013,109, Feb. 21, 1979, Pat. No. 4,397,126.

[51] Int. Cl.[3] ..... E04B 7/00

[52] U.S. Cl. ..... 52/741; 52/303; 52/199; 52/408

[58] Field of Search ..... 52/408, 199, 303, 741

[56] References Cited

U.S. PATENT DOCUMENTS

| | | |
|---|---|---|
| 1,958,871 | 5/1934 | Tucker . |
| 2,861,525 | 11/1958 | Curtis et al. . |
| 3,079,730 | 3/1963 | Donegan . |
| 3,122,073 | 2/1964 | Masse . |
| 3,125,479 | 3/1964 | Finan . |
| 3,266,206 | 8/1966 | Cosby et al. . |
| 3,411,256 | 11/1968 | Best . |
| 3,630,762 | 12/1971 | Olton et al. . |
| 3,694,306 | 9/1972 | Fricklas . |
| 3,763,605 | 10/1973 | Freeman . |
| 3,892,899 | 7/1975 | Klein . |
| 3,969,851 | 7/1976 | Whitacre . |
| 3,984,947 | 10/1976 | Patry . |
| 4,045,934 | 9/1977 | Sheahan et al. . |
| 4,223,486 | 9/1980 | Kelly . |
| 4,235,058 | 11/1980 | Patry . |
| 4,274,238 | 6/1981 | O'Riordain . |

FOREIGN PATENT DOCUMENTS

| | | |
|---|---|---|
| 1816577 | 4/1971 | Fed. Rep. of Germany . |
| 2027387 | 10/1979 | Fed. Rep. of Germany . |
| 2412386 | 2/1980 | Fed. Rep. of Germany . |
| 2427056 | 6/1980 | Fed. Rep. of Germany . |
| 632289 | 8/1945 | United Kingdom . |

*Primary Examiner*—Henry E. Raduazo
*Attorney, Agent, or Firm*—Darrell E. Hollis

[57] ABSTRACT

An energy-conserving roof structure for use in construction of low-slope roofs comprising two layers of permeable insulation and a layer of non-permeable insulation sandwiched between a pair of water vapor impermeable layers. The non-permeable insulation layer is placed to provide channels through which water will flow to roof drains. Closeable vents are provided adjacent the roof drains for venting water and water vapor. When the vents are closed the water vapor impermeable layers form a water vapor impermeable envelope around the insulation layers. Auxiliary vents are provided for venting the insulation layers to the ambient atmosphere at locations remote from the roof drains. By opening the vents when low-humidity conditions are present and closing the vents when high-humidity conditions are present moisture in the insulation layer is kept to a minimum, thereby maintaining the insulation layers at their highest thermal efficiency. Also a water-retentive mat may be interposed between the upper water vapor impermeable layer and a ballast layer to serve as a cooling layer in summer and a heat insulative layer in winter, and to serve as a protective mat to prevent damage to the upper layer of the water vapor impermeable envelope.

1 Claim, 6 Drawing Figures

ENVIRONMENTALLY ADAPTABLE ROOF STRUCTURE

STATEMENT OF GOVERNMENT INTEREST

The invention described and claimed herein may be manufactured and used by or for the Government of the United States of America for governmental purposes without the payment of royalties thereon or therefor.

CROSS REFERENCE TO EARLIER FILED APPLICATION

This application is a divisional of application Ser. No. 164,490 filed June 30, 1980 which is a continuation-in-part of application Ser. No. 13,109 filed Feb. 21, 1979, and now U.S. Pat. No. 4,397,126.

BACKGROUND OF THE INVENTION

The present invention relates to a roof structure, and more particularly to composite roof structures which take advantage of natural phenomena to maintain insulation layers at their highest thermal insulating efficiency.

The present invention relates to a composite roof structure and a method of using the structure in such way that it takes advantage of natural phenomena to extract moisture from the insulation. Moisture manifests itself in different forms and can change from one physical state to another. In the liquid state, it is usually referred to as water. In the solid state, it is usually referred to as ice or snow. In the gaseous state, it is usually referred to as water vapor. By gravity, water will drain only in a downward direction; whereas, water vapor will migrate in any direction—up, down, or laterally—dependent upon relative vapor pressure. As a natural phenomenon, water vapor will always attempt to migrate from an area of higher vapor pressure to an area of lower vapor pressure. At such place and time that the water vapor reaches a condition known as its dewpoint it will condense taking the form of water. If such condensation of water vapor occurs within a permeable insulation layer of a roof structure, the insulation layer will become moisture laden thereby reducing their thermal insulating efficiency. If channels are provided within the lower insulation layer, the condensation water can drain away by gravity. If the temperature of standing water falls below 0° C., it will turn to ice. Under certain conditions of very low humidity, ice can change to the vapor state by a phenomeon known as sublimation. If the temperature rises above 0° C., the ice will turn to water. If the humidity conditions change in favor of doing so, the water can return to the vapor state and move about again as a vapor.

On earth, the weather patterns change as the earth tilts on its axis causing the seasons of the year, known as Spring, Summer, Autumn and Winter. Extremes in temperature and humidity occur during the seasons known as Summer and Winter. During Winter, the temperature and humidity are usually lowest. In summer, the temperature and humidiy are usually highest.

The presence of moisture decreases the thermal efficiency of most types of insulation material. During Summer months under conditions of high humidity, water and vapor tends to migrate from the atmosphere into the roof insulation of air conditioned buildings. There the water vapor condenses to water near the deck level, each time conditions for a dewpoint are reached. Over a period of time a substantial volume of water can build up resulting in the insulation becoming saturated with water thereby reducing the efficiency of the insulation. This water is difficult to remove and the reduced efficiency of the insulation leads to substantial waste of energy.

Although the phenomena outlined above are well-known to meterologists, designers and constructers have not heretofore provided adequately for removal of moisture from roof insulation and for prohibition of seasonal ingress of moisture into the roof insulation. Although the prior art has provided for year-round venting, as exemplified by U.S. Pat. No. 2,192,458 to Swenson et al., the prior art has not provided for sealing out the vapor ingress which occurs during the Summer months as will be discussed, supra. Furthermore, the prior art has not provided for drainage channels and other adaptations or adjustments in configuration necessary to maximize the use of the natural phenomena to extract moisture from roofing installation during Winter months. Because the roof structure of the present invention results in substantial energy savings there exists a need to teach designers and constructors the techniques of the present invention for minimizing the amount of moisture permitted to enter the roof insulation layers and for utilizing the forces of nature to maximize the extraction of moisture from the insulation layers.

SUMMARY OF THE INVENTION

According to one aspect of the present invention, I provide an improved composite roof structure which is adaptable to various environments and can thereby take advantage of the above-discussed natural phenomena to provide an environmentally adaptable roof structure.

The roof structure of the present invention comprises the following, with the component parts stated in the order in which they are built up to form the composite roof structure. The roof structure includes a roof deck overlaid by a lower water vapor impermeable layer which is, in turn, overlaid by a layer of non-permeable insulation having channels through which water can flow to roof drains. The non-permeable insulation is, in turn, overlaid by a layer of low-adsorption insulation which can withstand repetitive freeze-thaw cycles. An upper water vapor impermeable layer overlays the low-adsorption insulation and, finally, a layer of ballasting is placed as the top layer of the composite roof. The composite roof structure slopes toward roof drains thereby providing means for draining water from the insulation layers through the channels provided. Openable and closeable vents are provided at the roof drains which provide means for draining water and venting vapor from the insulation layers by opening the vents during the low-humidity season and provide means for prohibiting ingress of water vapor from the atmosphere by closing the vents during the high-humidity season. When the vents are closed the water vapor impermeable layers form a water vapor impermeable envelope surrounding the insulation layers. The roof structure provides for overlapping and sealing of the upper and lower water-vapor impermeable layers at the perimeter of the building to form a vapor-tight seal enclosing the perimeter of the insulation layers. The vapor vent system also includes auxiliary venting means for venting the insulation layers to the ambient atmosphere at locations remote from the drains. These auxiliary vents are also openable and closeable, so that the entire venting system may be closed during the high-humidity season and opened during the low-humidity season. As another aspect of the invention, supplemental to the above composite roofing assembly, it is also contemplated that a water-retentive mat may be interposed between the upper water vapor impermeable layer and the ballast layer. This supplemental arrangement will provide added protection thereby ensuring the physical intergrity of the upper vapor impermeable layer and under certain environmental conditions conserving significant amounts of energy. According to the method, I provide a roof structure having layers of insulation enclosed in an envelope made of water vapor impermeable material and having openable and closeable vapor venting means in the envelope. Thereafter the method is accomplished by opening the vapor venting means during the early winter season when the humidity is low to thereby dry said insulation layer by permitting moisture to pass out of the insulation by gravity drainage, evaporation and sublimation. Thereafter, according to this aspect of the invention, I close the vapor venting means in late winter after an extended period of low humidity weather to seal out water vapor. Finally, according to this aspect of the invention, I maintain the vapor venting means in a closed condition during the humid summer months to prevent ingress of water vapor into the insulation whereby the highest level of thermal efficiency of said insulated roof may be maintained.

DESCRIPTION OF THE PREFERRED EMBODIMENT

Figure 1:
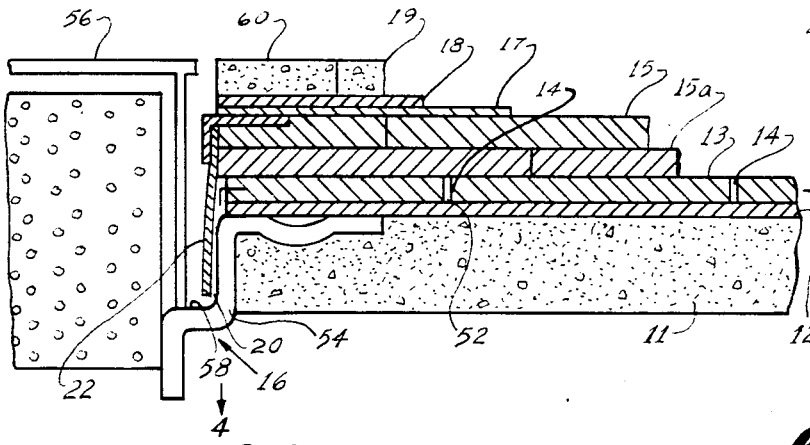
FIG. 1 shows a sectional view, with portions cut away, of the roof structure with vapor vents according to one aspect of the present invention.
Figure 1A:
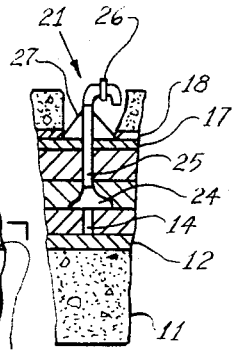
Figure 2:
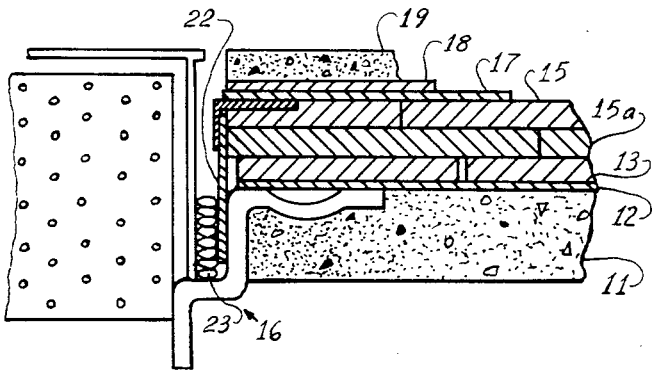
FIG. 2 is a partial sectional view illustrating a closed vapor vent according to one aspect of the present invention.
Figure 2A:
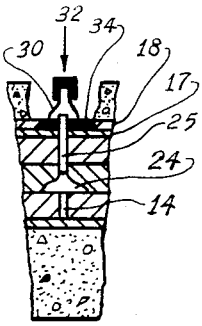

Referring to FIGS. 1 and 2, according to one aspect of the present invention, I provide a composite roofing system formed of various component materials.

The lowermost component is a roof deck 11. Although FIGS. 1 and 2 depict a concrete roof deck 11, the invention also contemplates the use of steel decks and other types of decks. Preferably, a deck sloped downward toward drain 16 of approximately ¼ inch per foot is used so that water within the insulation layers 13 and 15*a* and rain water impinging on layer 17 will move toward drain 16. Although only one drain 16 is shown in FIGS. 1 and 2, it is envisioned that a plurality of drains 16 may be provided depending on the climate and size of the roof. As shown in FIGS. 1 and 2 drain 16 includes an annular drainage fitting 54 held in place by roof deck 11. Annular drainage fitting 54 may be fabricated from steel or other compatible material known to those having skill in the art. Removable round cover 56 extends upwards from shoulder 58 of drainage fitting 54 to a plane coplanar with the top surface 60 of the roof structure. Cover 56 prevents debris from clogging drain 16 and is provided with holes for passage of water.

Applied to the top of roofdeck 11, a lower water-vapor impermeable layer 12 is provided to serve primarily to prevent migration of water vapor from the building up into the insulation. The water impermeable layer 12 also serves to drain away any condensate that occurs as a result of vapor entering from the external atmosphere and then reaching the dewpoint within the insulation layer 13 and 15.

The lower water vapor impermeable layer 12 is fabricated from material which is impervious to the passage of water vapor with sufficient impermeability to limit the water vapor transmission to 0.025 grams per 24 hours per square meter when tested in accordance with ASTM E 96-66, Procedure BW. Material such as butyl rubber or other comparable elastomeric materials may be utilized to fabricate layer 12 to meet the above impermeability standard. Also a built-up bituminous membrane may be utilized to form layer 12 if special accessories well known to the roofing trade (such as vapor tight reglets or metal transition plates) are provided to make a vapor tight connection with layer 17.

Figure 4:
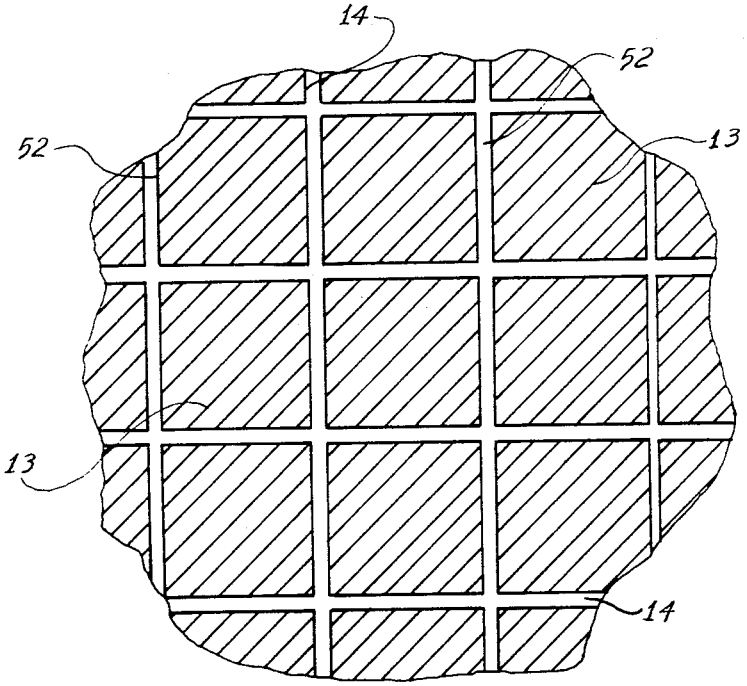
FIG. 4 is a cross-sectional view taken along lines 4—4 of FIG. 1.

Overlaying water vapor impermeable layer 12, I provide a non-permeable insulation layer 13 which, in addition to serving as insulation for the building, also serves as a bridge to hold overlaying permeable (but lower cost) low-adsorption insulation 15–15*a* up out of any vapor condensate water. The arrangement of the insulation 13 provides channels 14 through which any water vapor can pass to the atmosphere and condensate can pass to the roof drainage system generally designated at 16. As shown in FIGS. 1 and 4, insulation layer 13 is comprised of rectangular or square shaped sections disposed in spaced apart relationship thereby defining channels 14 between edges 52 thereof. As shown in FIG. 1, channel 14 extend from the top surface of insulation layer 13 to the bottom surface thereof. Preferably, for reasons related to the insulation properties of layer 13 the spacing between sections should be limited to a maximum of approximately one-half of an inch. Alternatively, other configurations or other materials could be utilized to fabricate layer 13 as long as the water and water vapor drainage function is retained. The non-permeable insulation 13 according to the present invention may be fabricated from materials such as cellular glass, or other material impervious to water vapor transmission. Therefore, while layer 13 is fabricated from water vapor impermeable material, layer 13 is configured in such manner as to provide channels through which water and water vapor may pass through the layer 13 to reach drains 16.

Overlaying non-permeable insulation layer 13, I provide a low adsorption layer 15–15*a* which serves primarily as insulation for the building.The insulation layer 15–15*a* also serves to keep the temperature of the non-permeable insulation layer 13 above freezing temperature, thereby protecting it from damage of freeze-thaw cycles. The low-adsorption layer 15–15*a* must be capable of withstanding any freeze-thaw cycling of moisture within itself by virtue of its ability to stand these stresses. The low-adsorption layer 15–15*a* according to the present invention may be fabricated from a material such as extruded polystyrene or other well known materials capable of withstanding the stresses of repeated freeze-thaw cycles.

Above the low-adsorption layer 15–15*a*, I provide an upper water vapor impermeable layer 17. Layer 17 serves to prevent water vapor, dust, rain, erosion particles, and the like, from passing downward into the insulation 15–5*a* and 13, and also serves to cause rainwater and snow-melt water to move directly to the drain system 16. According to the present invention, the upper water-vapor impermeable layer 17 is fabricated from the same or similar material as lower water-vapor impermeable layer 12. For example, layer 17 may be fabricated from an impermeable flexible, removeable sheeting, such as butyl rubber or other vapor impermeable products such as aluminum foil laminated to elastomeric, thermoplastic or heavy-weight polyethylene sheets. Upper layer 17 also meets the water vapor impermeability standard of limiting the water vapor transmission to 0.025 grams per 24 hours per square meter of material when tested in accordance with ASTME 96-66, Procedure B.W. Alternatively, it is realized that other water vapor impermeable materials that do not meet the above standard of water vapor impermeability could be utilized for upper and lower layer 12 and 17, however, such material will not provide the degree of dryness for insulation layers 13 and 15–15*a* nor the flexibility for maintenance and repair that are provided by the material for layers 12 and 17 described infra.

As seen in FIGS. 1 and 2, I provide a water-retentive mat 18 which provides additional energy-conservation benefits. In hot, sunny, humid Summer weather, a water-saturated mat at this location will tend to reduce energy consumption for air-conditioning within a building by providing a cooling overlaying the roof. In below-freezing Winter weather, the water in a wet mat will turn to ice and will provide additional insulation value at below freezing temperature, and if mat 18 is dry it will serve to provide additional insulation value. The mat also serves to provide added physical protection for the water-vapor impermeable layer 17 by filtering dirst, grit and other particles that may come to rest in the roof structure and by protecting it during placement of the ballast layer. The water-retentive mat 18 according to the present invention may be fabricated from a water-adsorptive material that filters out sediment, but permits slow permeation of water. The material used must withstand freeze-thaw cycles without being determinentally affected by water or ice. Mat 18 is capable of retaining water by adsorption, through adhesion of water molecules to the soild filaments of material with which they are in contact within mat 18. However, excessive amounts of water permeating mat 18 percolates slowly toward drain 16.

One such material providing these properties is manufactured by Monsanto Textiles Company, 800 N. Lindbergh Blvd., St. Louis, Mo. 63166 under the trademark BIDIM.

BIDIM is a continuous filament polyester fabric needled to form a highly permeable membrane. It provides the following properties, among others. It exhibits a high resistance to acids, alkali and hydrocarbons and is rot, mildew and vermin proof. In addition, bidim has excellent creep resistance, a high melting point, high abrasive resistance, and a high modulus of elasticity.

As seen in FIGS. 1 and 2, I provide a ballasting 19 on top of water-retentive mat 18. The ballasting layer 19 serves primarily to protect the enveloped insulation from uplift by wind. It also serves as a protective armor to protect the underlying materials from detrimental effects of direct exposure to natural elements such as sun, rain, hail and the like. The ballasting layer 19 according to the presentinvention may be fabricated from a material such as concrete patio pavers or aggregate. The water-retentive mat 18 is preferrably used for added protection of the upper water vapor impermeable layer 17 if an aggregate is used as a ballasting layer 19.

As seen in FIG. 1, the vapor vents 20 and 21 in the open positions permit moisture migration out of the insulation layers 13 and 15–15*a* during the low-humidity Winter season. These vents can be adjusted to a closed position at the end of the Winter season to prevent water vapor migration into the insulation layers during the high-humidity Summer season. The significance of enclosing the insulation layer 13 and 15–15*a* in a vapor tight envelope to prevent water-vapor migration into the insulation layers 13 and 15–5*a* during the high-humidity summer season needs further explanation. As explained infra water vapor will move from an area of high vapor pressure to an area of low vapor pressure. Therefore, in the high-humidity summer season the high water vapor concentrated in the ambient atmosphere will move into the insulation layers 13 and 15–15*a* if the vapor tight envelope is not provided, because when the conditions for dewpoint are reached, the water vapor in the insulation layers 13 and 15–15*a* condenses to form water. Once condensed, the water will not migrate back into the ambient atmosphere at the same rate at which it entered because the weather remains preponderantly humid during summer. Of course, the heat from the sun during the day will heat the water resulting in a portion of the water being converted to water vapor but a residual amount of water will remain unvaporized after each dewpoint condition. Thus, during the high-humidity summer season each time dewpoint conditions are reached, a residual amount of water that migrated into insulation layers 13 and 15–15*a* as water vapor remains there in the liquid state. This state. This phenomena results in a build-up of water in the liquid state within insulation layer 13 and 15–15*a* thereby reducing the thermal insulation efficiency. Thus during the summer months it is important to maintain insulation layers 13 and 15–15*a* in a water-vapor impermeable envelope thereby preventing the above-described build-up of water.

For the vapor vent 20 at the roof drain location, the present invention involves the use of vapor vent closure collars and curtains 22, with removeable pressure caulking rings 23 as seen in FIG. 2. When the removeable pressure caulking rings are in place as shown in FIG. 2 and auxiliary vents 21 and 30 are closed a water vapor impermeable envelope is formed around insulation layers 13 and 15–15*a*. For the auxiliary vents, 21, the cross-sectional view in FIG. 1 shows a pipe flange 24 placed on top of the open joint 14 between the pieces of non-permeable insulation 13. Attached to the pipe flange 24 is a pipe 25 extending upwardly from the flange through a vapor sealant collar 27 at the water vapor impermeable layer 17 and having a pair of 90° elbows such as conventional street ells, at the top for the open position. A removeable plug (not shown) may conveniently replace the second street ell 26 for the closed position.

Figure 3:
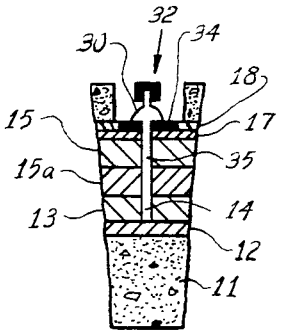
FIG. 3 is a cross-sectional view of a stem vent.

However, it is also visualized that other means such as capped rubber tube stem 30 sealed around openings in impermeable layer 17 may also be used for the auxiliary vents as shown in FIGS. 2 and 3. Rubber stem 30 is capped by removeable cap 32 or by screwed-in valve core (not shown) thereby preventing water vapor migration into insulation layer 13 and 15–15*a*. Stem 30 is sealed to impermeable layer 17 by sealant collar 34. Also tube stem 30 may be installed after the water-vapor impermeable envelope is in place. Once the envelope is in place, upper water-vapor impermeable layer 17 may be perforated by a spike (not shown) at a point located directly above a channel 14. Tube stem 30 having extension conduit 35 extending downward is inserted in the perforation with the conduit 35 extending downward through layers 13 and 15–15*a* to a point adjacent channel 14. Once in place tube stem 30 is thus sealed to impermeable layer 17 by sealant collar 34.

So that the water-vapor impermeable layer 17 and the impermeable water vapor layer 12 form a substantially vapor-tight envelope completely around the insulation layers, according to the present invention, it is contemplated that these barriers will be sealed around the periphery of the insulation assembly except for the appropriate openable and closeable openings to allow for the vapor venting function. The efficiency of the invention will improve with the degree to which an ideal totally vapor-tight envelope is achieved when all vents are in the closed position.

Except for the sealant to make the upper water vapor impermeable layer 17 and the lower water vapor impermeable layer 12 into a vapor-proof envelope, materials above the vapor barrier 12 will be loosely laid to facilitate maintenance and repair of the roofing system. Therefore the ballasting layer should be designed to be heavy enough to prevent uplight by winds and the deck structure 11 should be adequately designed to carry the ballasting load. If it becomes necessary to open the roofing system at any point for maintenance or repair, the water-vapor impermeable layer 17 may be cut to provide access. Further, when maintenance and repair operations are complete, the cut portions of the layer 17 may be repaired by lapping and sealing closure strips over the cuts to once again provide a water-vapor impermeable layer 17.

The present invention establishes a configuration of roofing components to inhibit and ingress of moisture into the roofing insulation layers and to facilitate the removal of moisture from the insulation layers, thereby making it possible to maintain the insulation in a relatively dry condition, thereby increasing the efficiency of the insulation in conserving energy. The present invention has been developed to accomplish adaption of the roofing structure to the environment and, in most areas of the northern hemisphere the invention is adapted for the carrying out of a process which can be accomplished by seasonal adjustments to be performed by maintenance personnel.

According to one aspect of the present invention, the vapor vent means can be opened during the winter season when the humidity is extremely low. This will permit moisture to pass out of the insulation layers by drainage, evaporation and sublimation. At the same time these phenomena are occurring, the layer 12 on the roof deck will prevent migration of additional water vapor from within the building up into the insulation layers 13 and **15–15*a*. Consequently, the insulation layers can be dried out. This dry condition allows the insulation layers to perform at their highest efficiency and prolongs the durability of the insulation. Vapor venting means can be closed in the late Winter after the extended period of low humidity weather has extracted the moisture from the insulation. By closing and sealing the vapor vent means 20 and 21** to prevent ingress of water vapor during the humid summer months, the insulation layers will remain in a relatively dry condition. This drying-out process can be repeated each year if necessary. By having maintenance personnel make the necessary adjustments to open and close the venting system of the present invention at the appropriate season of the year, the highest levels of efficiency of insulation materials can be maintained and substantial amounts of energy can be conserved.

The invention has been described in detail with particular reference to the preferred embodiments thereof, but is should be understood that variations and modifications can be affected within the spirit and scope of the invention as described herein and defined in the appended claims.

I claim:

1. A method for maintaining the insulation in a roof structure having at least one layer of insulation enclosed in a water vapor impermeable envelope with closeable water and water vapor vents in a dry condition comprising the steps of:

(a) opening said vents during the winter season when the humidity is low thereby drying said insulation layer by permitting moisture to pass out of said insulation by drainage, evaporation and sublimation;

(b) closing said vents in late Winter after an extended period of low humidity weather; and (c) maintaining said vents in a closed condition during the humid Summer months to prevent ingress of water vapor, with the attendant build-up of water within the insulation layers as a result of water vapor condensation when dewpoint conditions are reached, into said insulation whereby the highest level of efficiency of said insulated roof may be maintained.

* * * * *